US006929567B2

(12) United States Patent
Sullivan et al.

(10) Patent No.: US 6,929,567 B2
(45) **Date of Patent: *Aug. 16, 2005**

(54) SELECTIVELY WEIGHTED GOLF BALL

(75) Inventors: Michael J. Sullivan, Barrington, RI (US); Herbert C. Boehm, Norwell, MA (US)

(73) Assignee: Acushnet Company, Fairhaven, MA (US)

( * ) Notice: Subject to any disclaimer, the term of this patent is extended or adjusted under 35 U.S.C. 154(b) by 25 days.

This patent is subject to a terminal disclaimer.

(21) Appl. No.: 10/414,879

(22) Filed: Apr. 16, 2003

(65) Prior Publication Data

US 2003/0228935 A1 Dec. 11, 2003

Related U.S. Application Data

(60) Division of application No. 09/821,641, filed on Mar. 29, 2001, now Pat. No. 6,595,874, which is a continuation-in-part of application No. 09/447,653, filed on Nov. 23, 1999, now Pat. No. 6,485,378.

(51) Int. Cl.[7] ..... A63B 37/06

(52) U.S. Cl. ..... 473/374

(58) Field of Search ..... 473/355, 367, 473/368, 370, 371, 373, 374

(56) References Cited

U.S. PATENT DOCUMENTS

| | | | | |
|---|---|---|---|---|
| 697,925 | A | | 4/1902 | Kempshall |
| 698,516 | A | | 4/1902 | Kempshall |
| 700,658 | A | | 5/1902 | Kempshall |
| 701,741 | A | | 6/1902 | Kempshall |
| 704,748 | A | | 7/1902 | Kempshall |
| 704,838 | A | | 7/1902 | Kempshall |
| 711,508 | A | | 10/1902 | Kempshall |
| 720,852 | A | | 2/1903 | Smith, Jr. |
| 726,471 | A | | 4/1903 | Smith, Jr. |
| 757,600 | A | | 4/1904 | Crawford |
| 780,582 | A | | 1/1905 | Richards |
| 790,252 | A | | 5/1905 | Du Mahaut |
| 1,255,388 | A | | 2/1918 | Cobb |
| 1,426,712 | A | | 8/1922 | Chatfield |
| 1,482,232 | A | | 1/1924 | Hateltine |
| 1,524,171 | A | | 1/1925 | Chatfield |
| 1,553,386 | A | | 9/1925 | Kuhlke |
| 1,855,448 | A | | 4/1932 | Hazeltine |
| 2,055,326 | A | | 9/1936 | Young |
| 2,181,350 | A | | 11/1939 | Smith |
| 2,307,182 | A | | 1/1943 | Young |
| 2,364,955 | A | | 12/1944 | Diddel |
| 2,376,085 | A | | 5/1945 | Radford et al. |
| 3,228,686 | A | | 1/1966 | Faulkner, III |
| 3,256,019 | A | | 6/1966 | Barton |
| 3,738,655 | A | | 6/1973 | Feddick et al. |
| 4,173,345 | A | | 11/1979 | Pocklington |
| 4,203,941 | A | | 5/1980 | Brooker |
| 4,264,075 | A | | 4/1981 | Miller et al. |
| 4,625,964 | A | * | 12/1986 | Yamada ..... 473/373 |
| D348,915 | S | | 7/1994 | Fraser |
| 5,480,143 | A | | 1/1996 | McMurry |
| 5,820,485 | A | | 10/1998 | Hwang |
| 5,836,834 | A | | 11/1998 | Masutani et al. |
| 5,984,807 | A | | 11/1999 | Wai et al. |
| 6,213,893 | B1 | | 4/2001 | Maruko et al. |
| 6,485,378 | B1 | * | 11/2002 | Boehm ..... 473/374 |
| 6,595,874 | B2 | * | 7/2003 | Sullivan et al. ..... 473/374 |

FOREIGN PATENT DOCUMENTS

| | | |
|---|---|---|
| GB | 234713 | 6/1925 |
| GB | 1321270 | 6/1973 |
| GB | 2007581 A | 5/1979 |
| GB | 2162072 A | 1/1986 |
| JP | 9285565 | 11/1997 |

* cited by examiner

*Primary Examiner*—Raeann Gorden

(57) ABSTRACT

A golf ball comprising an inner core, an outer core, and a cover is disclosed. The outer core surrounds the inner core, and the cover encases the cores. The inner core is preferably a pre-formed selectively weighted symmetrical, but non-spherical insert, which may be made from either a high or low specific gravity material to control the moment of inertia and spin rate of the ball. The outer core is over-molded around the pre-formed insert to form a spherical core. Alternatively, the inner core insert has outer pockets defined thereon. These pockets are adapted to receive the outer core materials, which may have either a high specific gravity or a low specific gravity.

12 Claims, 5 Drawing Sheets

SELECTIVELY WEIGHTED GOLF BALL

CROSS-REFERENCE TO RELATED APPLICATIONS

The present application is a divisional application of Ser. No. 09/821,641, filed Mar. 29, 2001, now U.S. Pat. No. 6,595,874, which is continuation-in-part of U.S. patent application Ser. No. 09/447,653 filed on Nov. 23, 1999, now U.S. Pat. No. 6,485,378. The disclosures of the parent applications are incorporated herein in their entirety.

FIELD OF THE INVENTION

This invention generally relates to golf balls and, more particularly, to a selectively weighted golf ball.

BACKGROUND OF THE INVENTION

Conventional golf balls have been designed to provide particular playing characteristics. These characteristics typically include initial velocity, compression, and spin of the golf ball, and can be optimized for various types of players. For example, certain players prefer a ball that has a high spin rate in order to control the flight of the ball and to stop the golf ball on the green. This type of ball, however, does not usually provide maximum distance. Other players prefer a ball that has a low spin rate and high resiliency to maximize distance.

Early solid golf balls were generally comprised of a hard core and a hard cover. Generally, if the golf ball has a soft core and a hard cover, it has a low spin rate. If the golf ball has a hard core and a hard cover, it exhibits very high resiliency for distance, but a "hard" feel and is difficult to control on the greens. Additionally, if the golf ball has a hard core and a soft cover, it will have a high rate of spin. More recently developed solid balls are comprised of a core, at least one intermediate layer, and a cover. The intermediate layers improve the playing characteristics of solid balls and can be composed of thermoset or thermoplastic materials.

Typically, solid golf ball cores are spherical and solid. In an effort to improve the spin rate of balls, the weight distribution in the golf ball has been varied by concentrating the weight either in the spherical inner cores or in the mantle(s) near the surface of the ball. It is desired, therefore, to provide a golf ball with symmetrical, non-spherical weight distribution that provides unique spin rate characteristics.

Several patents are directed to inner cores that have been modified with non-spherical features such as bores or projections.

U.S. Pat. No. 720,852 issued to Smith discloses an internal core with small, solid protuberances projecting therefrom. The core is encased in a rubber layer having small, solid protuberances projecting therefrom. A silk layer is wound thereto, and then the ball is encased in an outer covering. The non-spherical core protuberances anchor the rubber and silk layers and increase the resiliency of the ball as a whole, but have no weight distribution function.

U.S. Pat. No. 1,524,171 issued to Chatfield discloses a core with a hollow, spherical center that supports cylindrical, solid lugs. A spherical casing surrounds and abuts the tips of the lugs. The lugs and casing are designed so that the casing compresses the lugs in the finished ball. Fluid or wound rubber bands occupy the space around the lugs, between the spherical center and the casing. The non-spherical lugs promote the accurate location of the center by facilitating uniform and spherical winding of the rubber bands about the center, but have no weight distribution function. An outer shell surrounds the casing.

U.K. Patent Application No. 2,162,072 issued to Slater discloses a golf ball with a non-spherical inner core that includes solid, support members or struts that diverge from a common center. The struts form a generally cubic, tetrahedral, or octahedral shaped core. The struts locate the inner core symmetrically within a mold cavity but perform no weight distribution. An outer core is molded about the inner core, and a cover is molded thereon. The inner and outer cores are formed from identical or similar materials.

U.S. Pat. No. 5,480,143 issued to McMurry discloses a substantially spherical practice ball comprising mutually perpendicular members with a plurality of walls that interconnect the members. The walls increase the drag on the ball so that smaller playing fields can be used.

U.S. Pat. No. 5,836,834 issued to Masutani et al. discloses a two or three piece golf ball comprising a two-layer solid core composed of a low-hardness inner core and a high-hardness outer core joined around the low-hardness inner core. A projection is formed on the inner surface of the high-hardness outer core such that the projection extends along an approximate normal direction, while a depression corresponding to the projection is formed in the outer surface of the low-hardness inner core, and the low-hardness inner core and the high-hardness outer core are joined together such that the projection is inserted into the depression.

Other patents disclose adding perimeter weights to golf balls to increase its moment of inertia. U.S. Pat. No. 5,984,806 discloses a golf ball with visible perimeter weights disposed on a spherical inner cover.

However, these patents do not disclose a golf ball having the configuration as disclosed herein to provide the improved golf balls of the present invention.

SUMMARY OF THE INVENTION

The present invention is directed to a golf ball having a core geometry designed to provide improved playing characteristics such as spin rate.

The present invention is also directed to a golf ball having an inner core that comprises a pre-formed selectively weighted insert.

The present invention is further directed to a golf ball comprising a pre-formed selectively weighted inner core insert adapted to have an outer core molded over the inner core. The ball also has a cover around the outer core. In accordance to one aspect of the invention, the pre-formed insert has a high specific gravity center hub and low specific gravity outer elements thereby forming a low moment of inertia, high spin rate ball. In accordance to another aspect of the invention, the pre-formed insert has high specific gravity outer elements forming a high moment of inertia, low spin rate ball.

In accordance to another aspect of the present invention, the inner core insert comprises outer pockets thereon. These pockets are adapted to receive a portion of the outer core material. When the outer core material has a high specific gravity the ball has high moment of inertia, and when the outer core material has a low specific gravity the ball has a low moment of inertia.

BRIEF DESCRIPTION OF THE DRAWING

In the accompanying drawings, which form a part of the specification and are to be read in conjunction therewith and in which like reference numerals are used to indicate like parts in the various views:

FIGS. 12(*b*) and 12(*c*) are cross-sectional views of variations of the embodiment shown in FIG. 12(*a*).

DETAILED DESCRIPTION OF THE PREFERRED EMBODIMENTS

Figure 1:
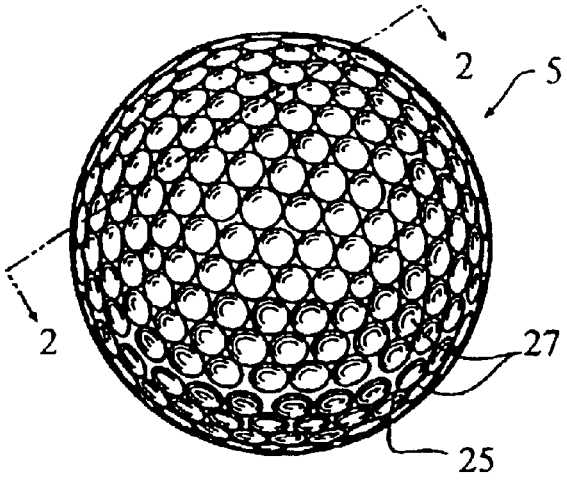
FIG. 1 is a side view of a golf ball according to the present invention.
Figure 2:
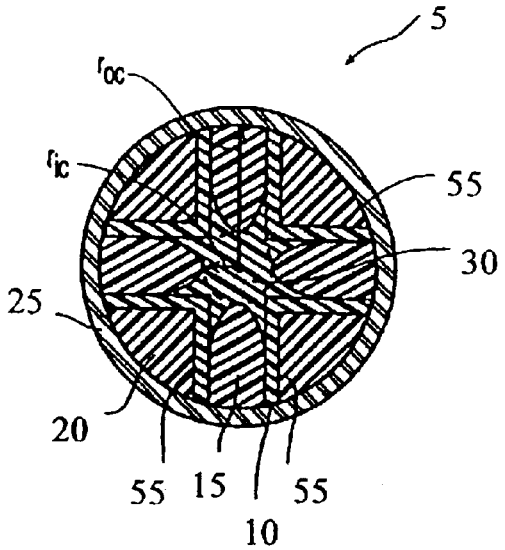
FIG. 2 is a cross-sectional view along the line 2—2 of FIG. 1 of the golf ball according to the present invention.
Figure 3:
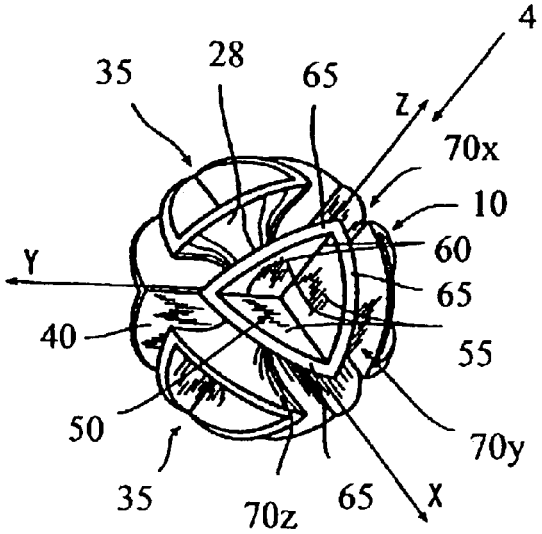
FIG. 3 is a side view of an inner core of the golf ball shown in FIG. 2.
Figure 4:
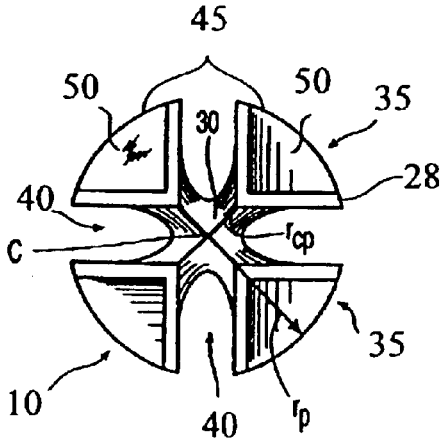
FIG. 4 is a plan view along the arrow 4 of FIG. 3 of the inner core according to the present invention.

Referring to FIG. 1, a golf ball 5 of the present invention is substantially spherical and has a cover 25 with a plurality of dimples 27 formed on the outer surface thereof. Referring to FIGS. 2–4, the golf ball 5 includes an inner core 10, an outer core 15 and 20, and the cover 25 (shown without dimples). The inner core 10 includes a three-dimensional outer surface 28, a center C, a central portion 30, and a plurality of projections 35. The central portion 30 and projections 35 are preferably integrally formed, so that the inner core is a unitary piece. Preferably, inner core 10 is a pre-formed insert that can be overmolded with other materials to form the core of the golf ball.

Referring to FIG. 4, the outer surface 28 of the inner core 10 is defined by the radial distances from the center C. At least two of the radial distances about the outer surface, $r_{cp}$ and $r_p$, are different. The central portion 30 of inner core 10 has a radius, designated by the arrow $r_{cp}$, that extends from the core center C to the outer surface of the central portion. The central portion 30 is solid in this embodiment but may be hollow, as discussed below.

Referring to FIGS. 3 and 4, each of the projections 35 extend radially outwardly from the central portion 30, and are spaced from one another to define gaps 40 there between. The projections 35 are shaped so that the inner core 10 is substantially symmetrical. Each projection 35 has an enlarged free end 45 and a substantially conical shape. Each free end 45 includes an open recess 50. Each projection has a radius, designated by the arrow $r_p$, that extends from the core center C to the outer surface 28 at the free end 45. The projection radii $r_p$ differ from the central portion radius $r_{cp}$.

Referring to FIG. 3, each recess 50 is formed by three integral side walls 55. Each of the side walls 55 is shaped like a flat quarter circle. The quarter circle includes two straight edges 60 joined by a curved edge 65. In each projection 35, each of the side walls 55 is joined at the straight edges 60. The curved edges 65 of each of the projections allow the inner core to have a spherical outline.

With reference to a three-dimensional Cartesian Coordinate system, there are perpendicular x, y, and z axii, respectively that form eight octants. There are eight projections 35 with one in each octant of the coordinate system, so that each of the projections 35 forms an octant of the skeletal sphere. Thus, the inner core is symmetrical. The gaps 40 define three perpendicular concentric rings $\mathbf{70}_x$, $\mathbf{70}_y$, and $\mathbf{70}_z$. The subscript for the reference number 70 designates the central axis of the ring about which the ring circumscribes.

Turning to FIGS. 2 and 4, the outer core includes a first section 15 and a second section 20. The first section 15 fills the gaps 40 around the projections 35, and is disposed between the side walls 55 of adjacent projections 35. It is preferred that the diameter of the core which includes the inner core and the outer core is between about 1.00 inches and about 1.64 inches for a ball having a diameter of 1.68 inches.

The second section 20 fills the recesses 50 of each projection 35, and is disposed between the side walls 55 of a single projection 35. The outer core is formed so that the outer core terminates flush with the free end 45 of each projection 35. The outer core has a substantially spherical outer surface. The cover 25 is formed about the inner core 10 and the outer core sections 15 and 20, so that both the inner and outer cores abut the cover.

Referring to FIG. 2, the formation of a golf ball starts with forming the inner core 10. As discussed above, inner core 10 is preferably pre-formed as an insert. The inner core 10, outer core sections 15 and 20, and the cover 25 can be formed by compression molding, by injection molding, or by casting. These methods of forming cores and covers of this type are well known in the art.

The inner and outer core materials preferably have substantially different material properties so that there is a predetermined relationship between the inner and outer core materials, to achieve the desired playing characteristics of the ball such as the spin rate of the ball. For instance, inner core 10 may be constructed from a low specific gravity material having a specific gravity of less than 0.9 or preferably less than 0.8. Outer core section 20, on the other hand, is preferably made from a high specific gravity material having a specific gravity of greater than 1.2, more preferably greater than 1.5 and most preferably greater than 1.8. Since outer core section 20 is denser and located more radially outward relative to inner core 10, ball 5 has a high moment of inertia and a low spin rate.

Figure 6:
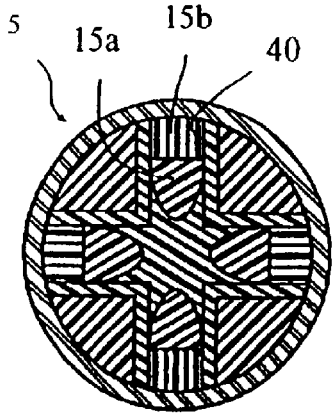

Outer core section 15 can be made from a material having a low specific gravity similar to the inner core 10. In this instance, outer core 20 has the highest specific gravity and contributes most to the ball's high moment of inertia. On the other hand, outer core section 15 may have the same specific gravity as outer core 20, so long as the total weight of the ball does not exceed the USGA legal weight of 1.62 ounces. Alternatively, as shown in FIG. 6, outer core section 15 can be divided into two zones 15*a* and 15*b*. Preferably, zone 15*b* has a high specific gravity of more than 1.2, more preferably more than 1.5, and most preferably more than 1.8. Zone 15*b* may have specific gravity similar to that of inner core 10. Similarly, outer core section 20 may also have a high specific gravity zone and a low specific gravity zone. Alternatively, projections 35 of inner core 10 may be made with a high specific gravity material while the rest of inner core 10 is made with a low specific gravity material to provide the ball with a high moment of inertia.

Figure 7:
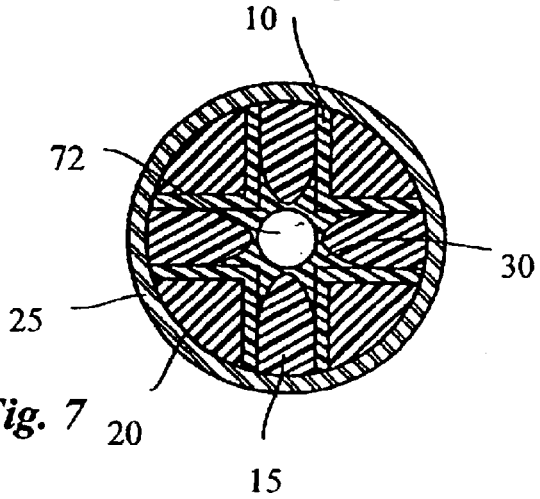

To further distribute the weight toward the outer core, inner core 10 may include hollow cavity 72, as shown in FIG. 7. Cavity 72 of inner core 10 may be filled with a low specific gravity liquid, such as mineral or lubricating oils, vegetable oil, methanol, ethanol, ammonia, etc., so long as the selected liquid does not react with the surrounding materials.

Figure 8:
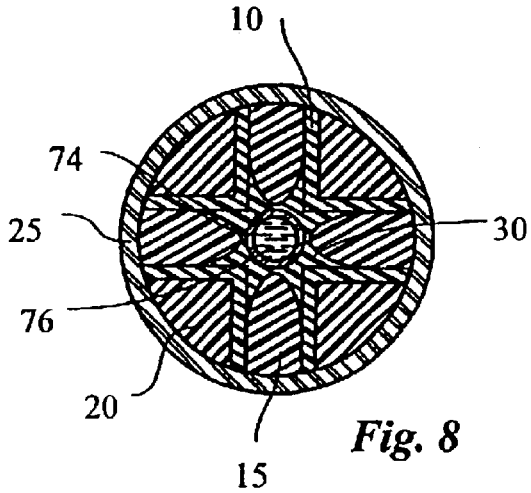

On the other hand, to make a low moment of inertia or high spin rate ball, central portion 30 of inner core 10 may be constructed from a high specific gravity material, while projections 35, outer core portion 15 or core portion 20, or any combination of these three elements can be made from a low specific gravity material. Preferably, central portion 30 has a specific gravity of greater than 1.2, more preferably greater than 1.5 and most preferably greater than 1.8. Preferably, the low specific gravity material has a specific gravity of less than 0.9 and more preferably less than 0.8. Center portion 30 can also be filled preferably with a non-reactive high specific gravity liquid such as glycerin or carbon tetrachloride. As shown in FIG. 8, cavity 72 of center position 30 has an envelope 74 encasing a fluid 76. Advantageously, envelope 74 can be made from a material capable of containing and isolating a reactive liquid such that such liquid can be used.

Suitable fluids usable in accordance with their specific gravities include air, aqueous solutions, liquids, gels, foams, hot-melts, other fluid materials and combinations thereof. Examples of suitable liquids include either solutions such as salt in water, corn syrup, salt in water and corn syrup, glycol and water or oils. The liquid can further include pastes, colloidal suspensions, such as clay, barytes, carbon black in water or other liquid, or salt in water/glycol mixtures. Examples of suitable gels include water gelatin gels, hydrogels, water/methyl cellulose gels and gels comprised of copolymer rubber based materials such a styrene-butadiene-styrene rubber and paraffinic and/or naphthenic oil. Examples of suitable melts include waxes and hot melts. Hot-melts are materials, which at or about normal room temperatures are solid but at elevated temperatures become liquid. A high melting temperature is desirable since the liquid core is heated to high temperatures during the molding of the inner core, outer core, and the cover. Alternatively, the liquid can be a selective reactive liquid system, which combines to form a solid. Examples of suitable reactive liquids are silicate gels, agar gels, peroxide cured polyester resins, two part epoxy resin systems, peroxide cured liquid polybutadiene rubber compositions, reactive polyurethanes, silicones and polyesters.

Suitable inner and outer core materials include thermosets, such as rubber, polybutadiene, polyisoprene; thermoplastics such as ionomer resins, polyamides or polyesters; or a thermoplastic elastomer. Suitable thermoplastic elastomers include Pebax®, Hytrel®, thermoplastic urethane, and Kraton®, which are commercially available from Elf-Atochem, DuPont, various manufacturers, and Shell, respectively. The inner and outer core materials can also be formed from a castable material. Suitable castable materials include urethane, polyurea, epoxy, and silicone. Additionally, other suitable core and cover materials are disclosed in U.S. Pat. No. 5,919,100 which is incorporated in its entirety herein by reference.

More specifically, the low specific gravity materials can be manufactured from a plastic polymer embedded with a density reducing filler such as hollow spheres or microspheres or is otherwise reduced in density, e.g., with foam. Additionally, suitable materials include a nucleated reaction injection molded polyurethane or polyurea, where a gas, typically nitrogen, is essentially whipped into at least one component of the polyurethane, typically, the pre-polymer, prior to component injection into a closed mold where full reaction takes place resulting in a cured polymer having reduced specific gravity. The materials are referred to as reaction injection molded ("RIM") materials. On the other hand, the high specific gravity layer may be made from a high density metal or from high density metal powder encased in a polymeric binder. High density metals such as steel, tungsten, lead, grass, bronze, copper, nickel, molybdenum or their alloys.

Figure 5:
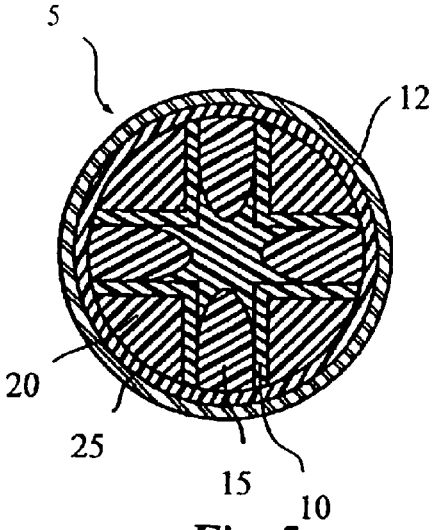
FIGS. 5–8 are cross-sectional views of the variations of the embodiment shown in FIGS. 2–4.

The cover 25 should be tough, cut-resistant, and selected from conventional materials used as golf ball covers based on the desired performance characteristics. The cover may be comprised of one or more layers, such as the ball shown in FIG. 5. Cover materials such as ionomer resins, blends of ionomer resins, thermoplastic or thermoset urethane, and balata, can be used as known in the art.

In accordance to another aspect of the invention, inner core 10 itself is a pre-formed selectively weighted structure. Preferably, the pre-formed selective weighted structure is a solid unitary element for the ease of manufacture. However, the present invention is not so limited. For example, as described above the projections 35 can be made from a different material than core 30 to achieve a desired weight distribution. The selectively weighted structure may be overmolded in any suitable fashion with outer core materials to form the core of golf ball 5. Injection molding, compression molding, reaction injection molding and casting are some of the preferred manufacturing methods. The pre-formed inserts in accordance to the present invention can focus or concentrate the weight of the ball either at the center of the ball, or at discrete locations proximate the ball's outer surface. These discrete locations are positioned symmetrically relative to the ball's outer surface so as not to affect the aerodynamic and rolling characteristics of the ball. The core or other mantle layers can be molded around the pre-formed insert such that they either fully enclose the pre-formed insert, or enclose most of the insert with the possibility of leaving some portions exposed or visible on the finished surface of the ball by leaving these portions flush with the surface.

Figure 9:
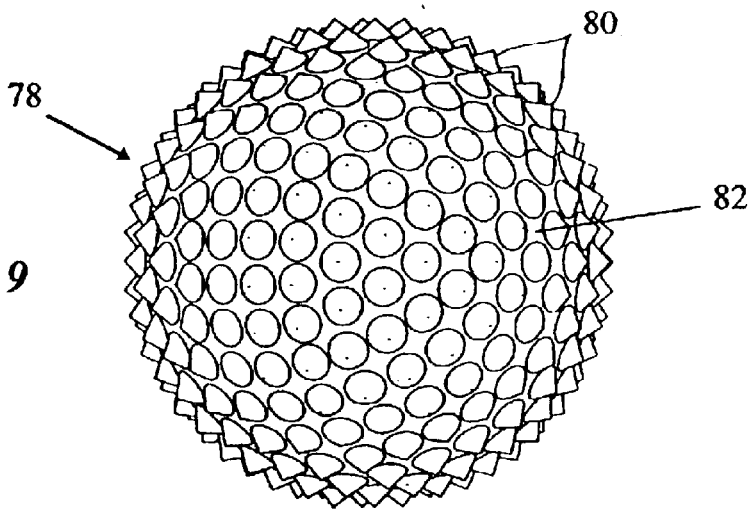
FIG. 9 is a side view of another embodiment of the inner core in accordance to the present invention.

Referring to FIG. 9, another embodiment of an inner core is shown. The inner core 78 includes a spherical central portion and a plurality of projections 80 extending radially outwardly from the central portion. The projections 80 include a base and a pointed free end. The projections 80 are preferably conical and taper from the base to the pointed free end. The projections 80 can have other shapes, such as polygons. Examples of polygonal shapes are triangles, pentagons, and hexagons.

Inner core 78 is an example of a pre-formed insert of the present invention, which provides a high moment of inertia and low spin rate ball. Preferably, projections 80 upstanding from surface 82 are made from a high specific gravity material, as discussed above, and the interior of core 78 is hollow or filled with a low density material or liquid. More preferably, the spherical surface 82 of core 78 is made from the same material as the projections 80. In this embodiment, the spherical surface 82 and the projections 80 are located proximate to the surface of the ball to maximize the ball's moment of inertia.

Figure 10:
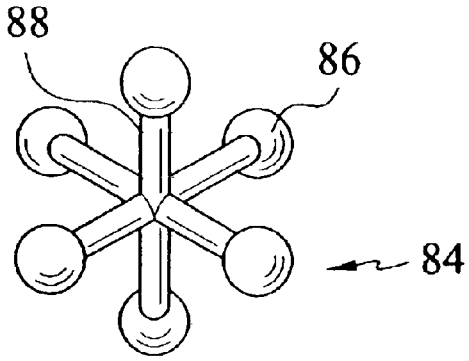
FIGS. 10(*a*)–10(*d*) are side views of other embodiments of the inner core in accordance to the present invention.
Figure 10:
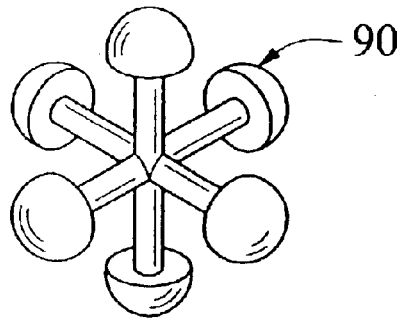
Figure 10:
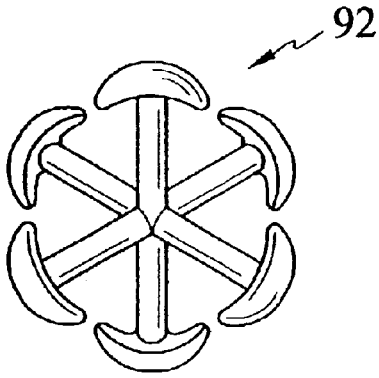
Figure 10:
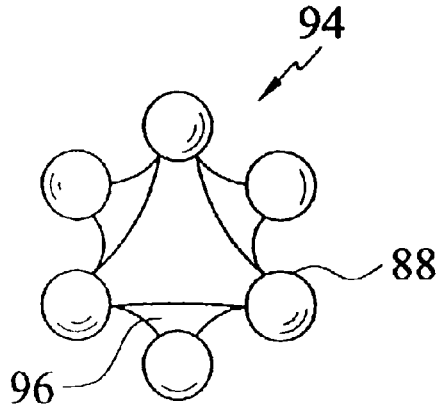

FIGS. 10(*a*), 10(*b*), 10(*c*), and 10(*d*) illustrate other embodiments of the pre-formed insert in accordance to the present invention that provide a high moment of inertia ball. A ball-and-rod insert 84 is shown in FIG. 10(*a*). Preferably, the insert 84 is made from a high density material. Since balls 86 are significantly larger than rods 88, and are located radially further away from the center of the golf ball than rods 88, balls 86 impart a higher moment of inertia to the golf ball. Advantageously, since balls 86 and rods 88 are preferably made from the same material the manufacturing process is simplified. To further maximize the moment of inertia, rods 88 may be hollow. Alternatively, hollow rods 88 may be filled with a low specific gravity fluid, or rods 88 can be made from a low specific gravity material or are filled with a low density filler.

Similarly, balls 88 can be enlarged to further maximize the moment of inertia, such that the ball-and-rod configuration becomes a mushroom configuration as shown in FIG. 10(*b*) or an anchor configuration as shown in FIG. 10(*c*). The above discussion relating to the ball-and-rod insert 84 also applies to the mushroom insert 90 and anchor insert 92. FIG. 10(*d*) illustrates another variation of the ball-and-rod configuration. The webbed ball-and-rod pre-formed insert 94 comprises a plurality of balls 88 connected together by webbed legs 96. Advantageously, the weights from the balls 88 and webbed legs 96 are disposed toward the outer perimeter of the golf ball to maximize the moment of inertia. The balls 88 of insert 94 may also be enlarged to have a mushroom shape or an anchor shape.

Figure 11:
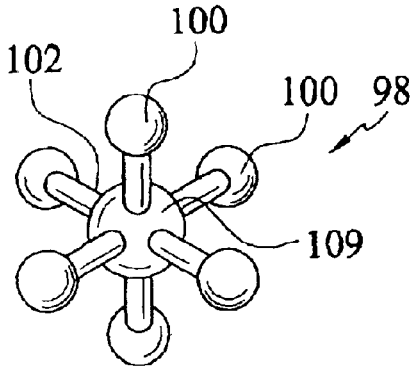
FIGS. 11(*a*)–11(*e*) are side views of other embodiments of the inner core in accordance to the present invention.
Figure 11:
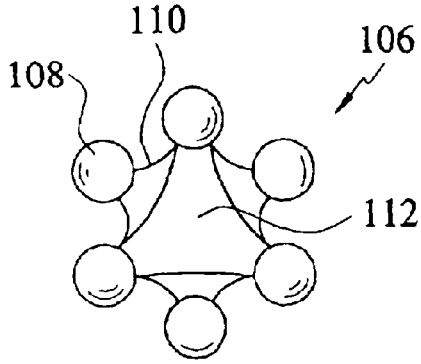
Figure 11:
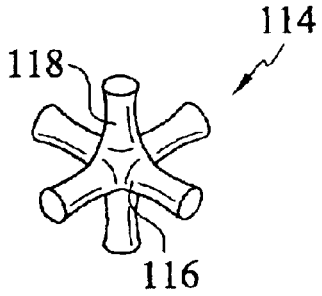
Figure 11:
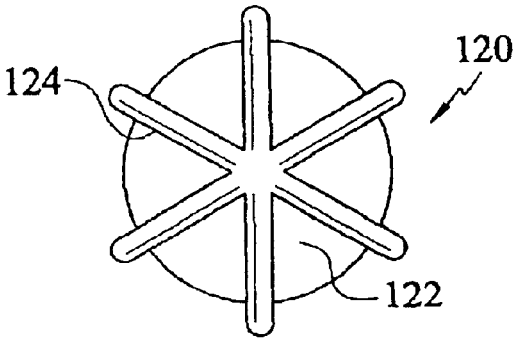
Figure 11:
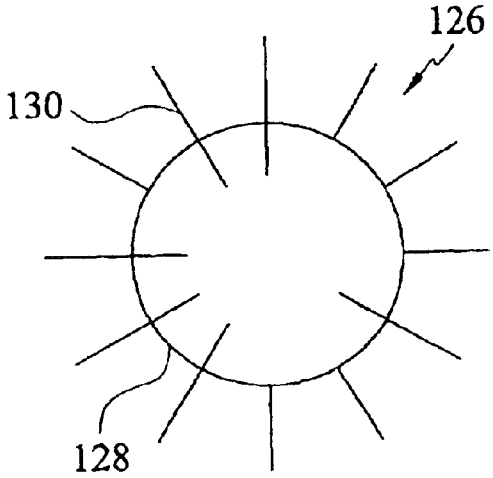

FIGS. 11(*a*), 11(*b*), 11(*c*), 11(*d*) and 11(*e*) illustrate low moment of inertia embodiments of the pre-formed insert inner core in accordance to the present invention. FIG. 11(*a*) is substantially similar to the ball-and-rod insert shown in FIG. 10(*a*). Preformed insert 98 comprises a plurality of low specific gravity balls 100 connected by rods 102 to high specific gravity hub 104. Hub 104 preferably has a specific gravity much higher than that of balls 100. Suitable high and low specific gravity materials are discussed above. Preferably, rods 102 are also made from low specific gravity material. Alternatively, either balls 100 or rods 102, or both, may be hollow. Also, insert 98 may have a mushroom or anchor configuration. High gravity insert 106, shown in FIG. 11(*b*), is substantially similar to insert 94 shown in FIG. 10(*d*), except that balls 108 are made from a low specific gravity material. Balls 108 and webbed legs 110 define a center 112. Center 112 is adapted to receive a high specific gravity element such as a metal ball bearing or other heavy objects. Alternatively, center 112 may be filled with a high specific gravity moldable material. Balls 108 may also be hollow. Webbed legs 110 preferably center and hold the ball bearing in place during the molding process. Alternatively, insert 106 may also have a mushroom or anchor configuration.

FIG. 11(*c*) illustrates a hub-and-rod insert 114, which is similar to the insert 98 of FIG. 11(*a*), except that insert 114 has hub 116 and rods 118, but does not have the low specific gravity balls disposed at the end of rods 118. Insert 114 is preferably made from a high specific gravity material discussed above.

FIG. 11(*d*) shows insert 120, which comprises a high specific gravity center 122 surrounded by a plurality of rings 124. Rings 124 help to position and center insert 120 in the mold cavity. Similarly, insert 126, shown in FIG. 11(*e*), has high density hub 128 surrounded by a plurality of radially extending centering pins 130.

Figure 12:
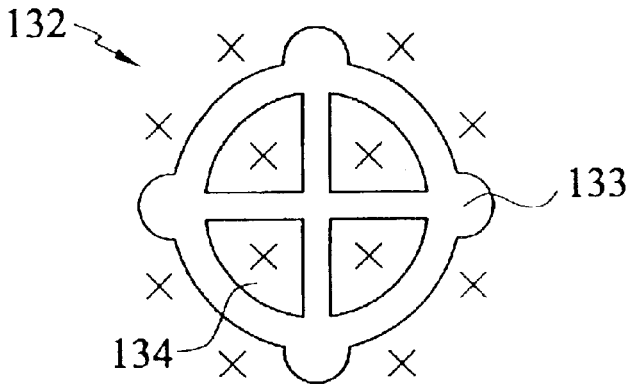
FIG. 12(*a*) is a side view of another embodiment of the inner core in accordance to the present invention.
Figure 12:
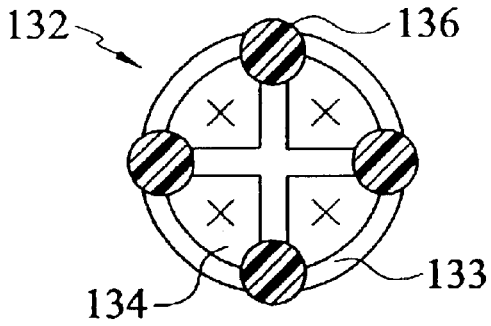
Figure 12:
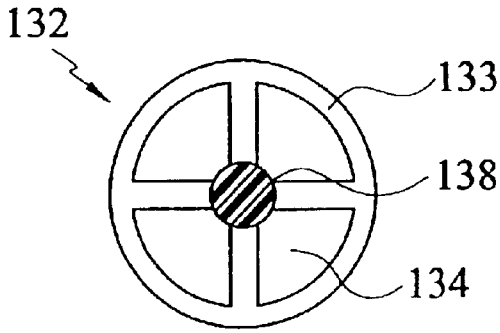

In accordance to yet another aspect of the invention, FIGS. 12(*a*), 12(*b*) and 12(*c*) illustrate other embodiments of the pre-formed insert as a continuous configuration having chambers that may be solid, hollow, or partially filled. As shown in FIG. 12(*a*), insert 132 comprises a shell 133 with openings 134 on its surface. Core materials can be molded around the open shell 133 and penetrate its interior through openings 134. Insert 132 may be made from a low specific gravity material or be hollow, and the core material can be a high specific gravity material to provide a low moment of inertia ball. On the other hand, insert 132 can be made from a high specific gravity material and the core material can be a low specific gravity material to provide a high moment of inertia ball. Alternatively, insert 132, shown in FIG. 12(*b*), may have chambers 136 filled or partially filled with high specific gravity material to produce a perimeter weighted ball. On the other hand, insert 132, shown in FIG. 12(*c*), may have a dense hub 138 centrally located in open shell 133. Hub 138 can be made from a high specific gravity material such as a metal ball bearing, and shell 133 can be made from a low specific gravity material or be hollow. Preferably, shell 133 is sized and dimensioned such that it is located proximate to cover 25 of the golf ball 5.

Furthermore, the location of the balls 86, 100, 108, the mushroom and anchor heads, and chambers 136, as well as hubs 104, 116, 122, 128 and 138, and center 112 shown in FIGS. 10(*a*)–12(*c*) can be maximized if these structures are positioned relative to the centroid radius of the ball. The centroid radius is the radial distance from the center of the ball, where the moment of inertia switches from being increased and to being decreased as a result of the redistribution of weight when compared to the moment of inertia for a ball with no weight reallocation. In other words, when more of the ball's mass or weight is reallocated to the volume of the ball from the center to the centroid radius, the moment of inertia is decreased, thereby producing a high spin ball. When more of the ball's mass or weight is reallocated to the volume between the centroid radius and the outer cover, the moment of inertia is increased thereby producing a low spin ball. The centroid radius is discussed in detail in co-pending application entitled "Golf Ball and a Method for Controlling the Spin Rate of Same," bearing Ser. No. 09/815,753, filed Mar. 23, 2001. This application is incorporated in its entirety herein by reference.

Hence, it is advantageous to locate balls 86, 100, 108, the mushroom and anchor heads, and chambers 136 between the cover of the ball and the centroid radius, and to locate hubs 104, 116, 122, 128 and 138, and center 112 between the center of the ball and the centroid radius.

Furthermore, although only six balls 86, 100, 108, six mushroom and anchor heads, and four chambers 136 are illustrated in the drawings, the pre-formed insert 10 may have any number of balls, mushroom and anchor heads, and chambers, as long as they are symmetrically located on the golf ball.

While it is apparent that the illustrative embodiments of the invention disclosed herein fulfill the objectives stated above, it is appreciated that numerous modifications and other embodiments may be devised by those skilled in the art. One such modification is that the outer surface can be flush with the inner surface free ends or it can extend beyond the free ends. Therefore, it will be understood that the appended claims are intended to cover all such modifications and embodiments, which would come within the spirit and scope of the present invention.

What is claimed is:

1. A golf ball comprising:

a pre-formed selectively weighted inner core insert comprised of a hub having a specific gravity of greater than 1.2 and a plurality of outer elements having a specific gravity of less than 0.9 that are connected together;

an outer core molded over the inner core insert; and a cover disposed around the outer core.

2. The golf ball of claim 1, wherein the hub has a specific gravity of greater than 1.5.

3. The golf ball of claim 2, wherein the hub has a specific gravity of greater than 1.8.

4. The golf ball of claim 1, wherein the outer elements have a specific gravity of less than 0.8.

5. The golf ball of claim 4, wherein the outer elements are hollow.

6. The golf ball of claim 1, wherein the outer elements are coupled together by webbed legs.

7. The golf ball of claim 6, wherein the webbed legs align and center the hub.

8. A golf ball comprising:

a pre-formed selectively weighted inner core insert comprised of a hub having a specific gravity of less than 0.9, a plurality of outer elements having a specific gravity of greater than 1.2 and means for coupling the outer elements;

an outer core molded over the inner core insert; and a cover disposed around the outer core.

9. The golf ball of claim 8, wherein the means for coupling the outer elements are a plurality of webbed legs.

10. The golf ball of claim 9, wherein the webbed legs align and center the hub.

11. The golf ball of claim 8, wherein the outer elements have a specific gravity greater than 1.5.

12. The golf ball of claim 8, wherein the outer elements have a specific gravity greater than 1.8.

* * * * *